US005852829A

United States Patent [19]

Relaford

[11] Patent Number: 5,852,829

[45] Date of Patent: Dec. 29, 1998

[54] BELT WITH CHANGEABLE DECORATIVE STRIPS

[76] Inventor: Shadrach Relaford, 750 S. Dickerson, Apt. 412, Arlington, Va. 22204

[21] Appl. No.: 883,084

[22] Filed: Jun. 26, 1997

Related U.S. Application Data

[63] Continuation-in-part of Ser. No. 707,374, Sep. 4, 1996, abandoned.

[51] Int. Cl.[6] ..... A41F 9/00

[52] U.S. Cl. ..... 2/338; 2/311

[58] Field of Search ..... 2/338, 311, 312, 2/336

[56] References Cited

U.S. PATENT DOCUMENTS

| | | | |
|---|---|---|---|
| 2,691,172 | 10/1954 | Breslow | 2/312 |
| 3,848,270 | 11/1974 | Rand | 2/311 |
| 4,060,854 | 12/1977 | Friedman et al. | 2/338 |
| 4,137,660 | 2/1979 | Dettmann et al. | 2/312 X |
| 4,340,976 | 7/1982 | Wright | 2/338 |
| 4,521,923 | 6/1985 | Mackey | 2/338 |
| 4,581,271 | 4/1986 | Gordon | 2/311 X |
| 4,639,948 | 2/1987 | Adell | 2/311 |
| 4,918,758 | 4/1990 | Rendina | 2/171 |

FOREIGN PATENT DOCUMENTS

| | | | |
|---|---|---|---|
| 2677227 | 12/1992 | France | 2/338 |
| 629393 | 12/1961 | Italy | 2/338 |

*Primary Examiner*—Gloria M. Hale
*Attorney, Agent, or Firm*—Larson & Taylor

[57] ABSTRACT

An apparel belt includes a body encircling member for fastening around the torso of the wearer and decorative strips which are attachable to the outer side of the body encircling member. Each of the decorative strips includes a pair of socket elements which are engageable with stud elements located along the length of the body encircling member. The decorative strips are interchangeable and may include different letters or words thereon allowing the wearer to communicate a message. The decorative strips may be attached over belt loops on a garment such that the belt loops are not visible when the apparel belt is worn.

6 Claims, 3 Drawing Sheets

BELT WITH CHANGEABLE DECORATIVE STRIPS

RELATED APPLICATIONS

This application is a continuation-in-part of application Ser. No. 08/707,374 now abandoned, filed Sep. 4, 1996.

FIELD OF THE INVENTION

The present invention relates to an apparel belt and, more particularly, to a belt which includes means for attachment of interchangeable decorative strips.

BACKGROUND OF THE INVENTION

Many of the garments which are worn today have words or designs printed on them, allowing the wearer to express his or her beliefs, allegiance, etc. Perhaps most common are t-shirts which include the indicia of sports teams, amusing expressions or other symbols. However, designs and messages may also be displayed on other types of garments. For example, U.S. Pat. No. 4,918,758 to Rendini discloses a changeable message stretch band which allows the wearer to communicate words and expressions through the use of removable graphics. More specifically, the graphics may be added to or removed from the stretch band by means of hook and loop fasteners.

U.S. Pat. No. 4,581,271 to Gordon discloses a holder for displaying indicia on belts, bracelets, animal collars and the like. The holder includes multiple openings which are designed to receive projections on indicia which are inserted into the holder. Thus, changing the display in the holder can be tedious. Moreover, the holder and/or indicia must necessarily be constructed from a fairly rigid material which may feel uncomfortable when worn.

U.S. Pat. No. 4,521,923 to Mackey also discloses a belt having a holder into which letters may be inserted. Like Gordon, Mackey utilizes projections on the indicia to hold the indicia inside recesses or slots in the holder. Thus, insertion or removal of the indicia tends to be time-consuming.

U.S. Pat. No. 3,848,270 to Rand discloses a belt having an interchangeable decorative strip. The strip is designed to cover the entire exterior of the belt and is fastened on the underside of the belt. The strip may be fastened to the belt using snap fasteners or hook and loop fasteners. The belt is only designed to receive a single decorative strip.

SUMMARY OF THE INVENTION

Thus, it is the purpose of the present invention to overcome the disadvantages of the prior art and thereby provide an apparel belt which includes interchangeable decorative strips which may be quickly and easily removed, thereby allowing the wearer to display different designs and/or communicate different messages.

In accordance with a preferred embodiment of the invention, a belt designed to be worn around the torso includes a body encircling member having an inner side which is placed against the wearer's body and an outer side on which stud elements are attached at varying locations along a length of the body encircling member. The belt further includes at least two decorative strips each having a socket element attached at respective ends thereof for engaging the stud elements on the body encircling member. In this way, one or more of the decorative strips may be worn at varying locations on the body encircling member.

It is, therefore, an object of the present invention to provide an apparel belt which includes decorative strips which include indicia thereon for communicating a message.

It is another object of the invention to provide an apparel belt with a set of removable decorative strips having different lengths such that the appearance of the belt may be varied.

It is still another object of the invention to provide an apparel belt which includes a sufficient number of decorative attachments to substantially completely cover the length of the belt.

It is yet another object of the invention to provide a set of decorative strips for covering the belt loops on a garment such as pants or a skirt.

These and other objects of the present invention will become apparent from the detailed description that follows.

BRIEF DESCRIPTION OF THE DRAWINGS

There follows a detailed description of the preferred embodiments of the present invention which are to be taken together with accompanying drawings, wherein.

DESCRIPTION OF THE PREFERRED EMBODIMENTS

Referring now to the figures, like elements are represented by like numerals throughout the several views.

Figure 1:
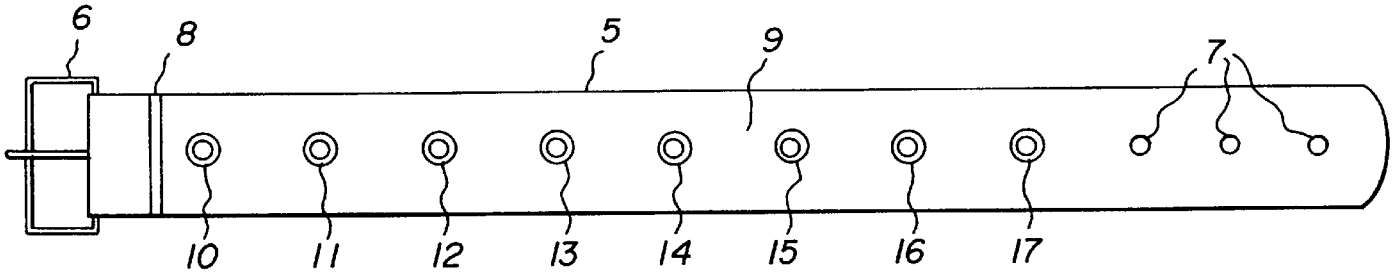
FIG. 1 is a front view of the outer side of the body encircling member of the belt of the invention.

FIG. 1 shows the belt 1 of the invention before attachment of the decorative strips 2, 3, 4, shown and described in greater detail in connection with FIG. 2. The belt 1 includes a body encircling member 5. The body encircling member 5 may be constructed in any length, dependent on whether it is designed to fit around the torso of a child or an adult, a man or a woman. Fastening means for securing the body encircling member 5 around a wearer's torso may be in the form of a buckle 6 attached to one end of the body encircling member which engages one of several apertures 7 at the opposite end of the body encircling member, the free end of the body encircling member being insertable through a loop 8 near the buckle 6. The fastening means could, of course, be in the form of a hook and loop type fastener, or a snap type fastener and the like.

The outer side 9 of the body encircling member 5 has stud elements 10–17 secured thereto between opposite ends of the body encircling member 5. As shown, there are eight stud elements 10–17 attached to the body encircling member 5. However, any number of stud elements may be attached to the body encircling member 5 and, further, these stud elements 10–17 may be evenly spaced as shown, or spaced at varying distances from one another. For example, stud elements 10 and 11 could be spaced two inches apart and stud elements 11 and 12 could be spaced three inches apart. Preferably, however, there is a consistent pattern of spacing between stud elements such that the body encircling member 5 has an attractive appearance and can be worn without the attachment of decorative strip elements 2, 3, 4. The stud elements 10–17 may be secured to the outer side 9 of the body encircling member 5 by an adhesive or, more preferably, they extend through the body encircling member 5 and are secured on the inner side 18 by some type of an anchoring element 19, which is well known in the art, as shown in FIG. 3.

Figure 2:
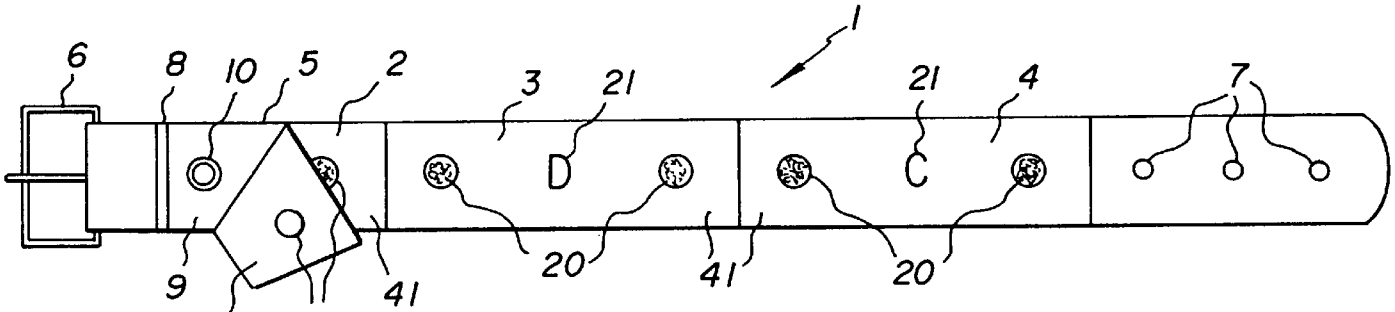
FIG. 2 is a front view of the outer side of the belt of the invention on which decorative strips have been attached using socket and stud elements.

FIG. 2 shows the belt 1 of the invention in which three decorative strips 2, 3, 4 have been attached to the body encircling member 5. The decorative strips 2, 3, 4 are attached to the body encircling member 5 by means of socket elements 20 which engage the stud elements 10–17 on the body encircling member 5. As shown, each decorative strip 2, 3, 4 includes a pair of socket elements attached at respective ends thereof. Decorative strip 2 is shorter in length than decorative strips 3 and 4, such that the socket elements 20 on decorative strip 2 engage adjacent stud elements 10, 11, while the stud elements 20 on decorative strips 3, 4 engage every other stud element 12, 14 and 15, 17, respectively. Alternatively, decorative strips 3, 4 could include three socket elements 20 such that stud elements 14, 16, respectively, are also engaged. Moreover, the decorative strips 2, 3, 4 may be of any length. For example, the belt may include a set of decorative attachments comprising several decorative strips having varying lengths; i.e., one decorative strip having a length sufficient to cover all of the stud elements 10–17, eight individual decorative strips each of which covers only one of the stud elements 10–17, and several other decorative strips having lengths somewhere between the distance between stud elements 10 and 17. Most typically, the decorative strips have a length between four and twelve inches.

Preferably, as shown in FIG. 2, each of the decorative strips includes indicia 21 on the front side 41 thereof, which may be single letters, or an entire word such that the wearer can communicate a desired message or simply display his or her initials.

Figure 3:
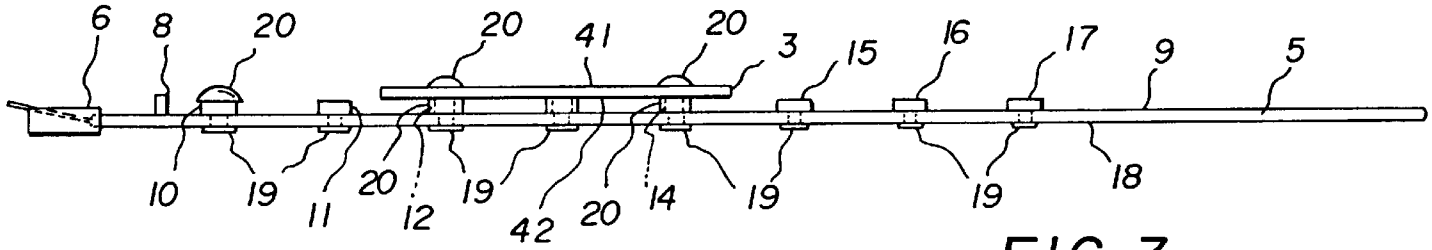
FIG. 3 is a side view of the belt of the invention on which a single decorative strip has been attached to the body encircling member.

FIG. 3 shows a side view of the belt 1 on which only one decorative strip 3 has been attached to the body encircling member 5. The belt 1 can be worn in this fashion, since the stud elements 10, 11, 15, 16, 17 which remain exposed do not detract from the appearance of the belt 1. Alternatively, socket elements 20 can be placed over the stud elements which are not being used. As shown, a socket element 20 has been placed over stud element 10. The belt 1 can also be worn without the decorative strips and with socket elements 20 placed over each of the stud elements 10–17. Although the stud elements are shown on the body encircling member 5 and socket elements are shown on the decorative strips 2, 3, 4, it is possible to utilize the converse construction, i.e., with the socket elements on the body encircling member 5 and the stud elements on the decorative strips 2, 3, 4.

Figure 4:
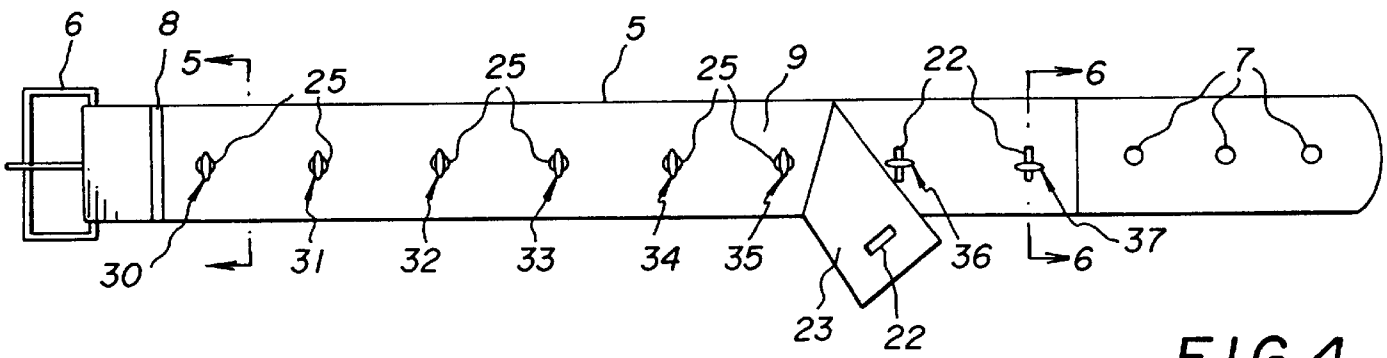
FIG. 4 is a front view of another embodiment of the invention, similar to FIG. 2 in which lock elements are used in place of socket and stud elements.

FIG. 4 shows another embodiment of the invention in which lock elements are secured to the outer side 9 of the body encircling member 5. As shown, there are eight lock elements 30–37 attached to the body encircling member 5. However, any number of lock elements may be attached to the body encircling member 5. These lock elements 30–37 may be spaced in differing ways as described above in connection with the socket and stud elements in FIG. 1.

Figure 5:
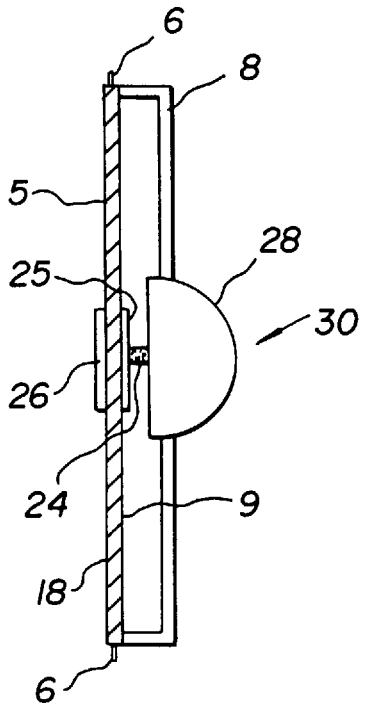
FIG. 5 is a cross-sectional view of the belt shown in FIG. 4 taken along the line 5—5.

FIG. 5 shows a cross-sectional view of the body encircling member 5 and lock element 30 of FIG. 4 before attachment of a decorative strip. As shown, lock element 30 includes a flat, semi-circular protrusion 28, although the protrusion 28 may have any suitable shape such as rectangular. Lock element 30 also includes coin-shaped disks 25, 26 which rest against the outer side 9 and inner side 18, respectively and are secured to one another by a rod 27 extending through body encircling member 5 and attached to both disks 25, 26. Lock element 30 could also be secured to body encircling member 5 by adhesive or other known securing means. Protrusion 28 is attached to disk 25 by spring means 24 which allows protrusion 28 to be rotated with respect to disk 25 between unlocked and locked positions shown in FIGS. 5 and 6, respectively, i.e., about 90 degrees. Protrusion 28 may also be rotatable through a full 360 degrees.

Figure 6:
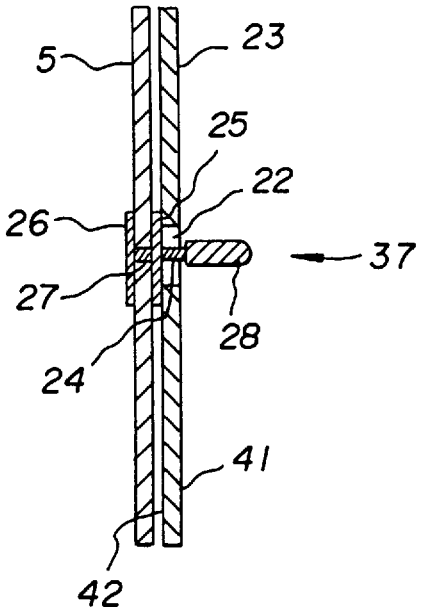
FIG. 6 is a cross-sectional view of the belt shown in FIG. 4 taken along the line 6—6.

FIG. 6 shows a cross-sectional view of the body encircling member 5 and lock element 37 of FIG. 4 after attachment of a decorative strip 23. Referring to FIGS. 4 and 6, protrusion 28 as shown in the positions of lock elements 30–35 is inserted through rectangular shaped slot 22 on decorative strip 23. Protrusion 22 is then rotated into the position shown for lock elements 36 and 37 such that the decorative strip 23 is held securely in place against the outer side 9 of the body encircling member 5. Lock elements 37 also provide an attractive appearance such that the body encircling member 5 may be worn without decorative strips.

Figure 7:
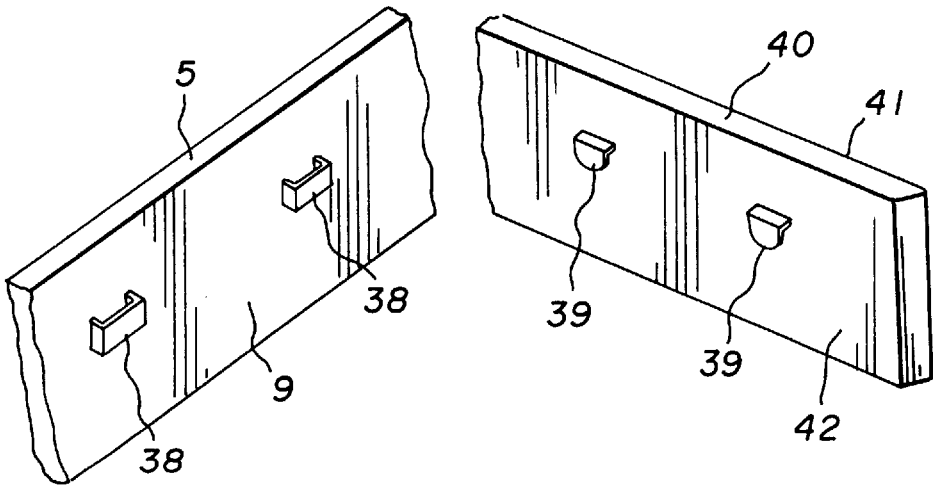
FIG. 7 is a perspective view of the another embodiment of the invention showing the outer side of a portion of the belt and back side of a decorative strip in which hooks and loops are used in place of socket and stud elements.

FIG. 7 shows another embodiment of the invention in which hooks 39 on the back side 42 of decorative strip 40 slide into loops 38 on the front side 9 of body encircling member 5 to secure the decorative strip 40 thereto.

Figure 8:
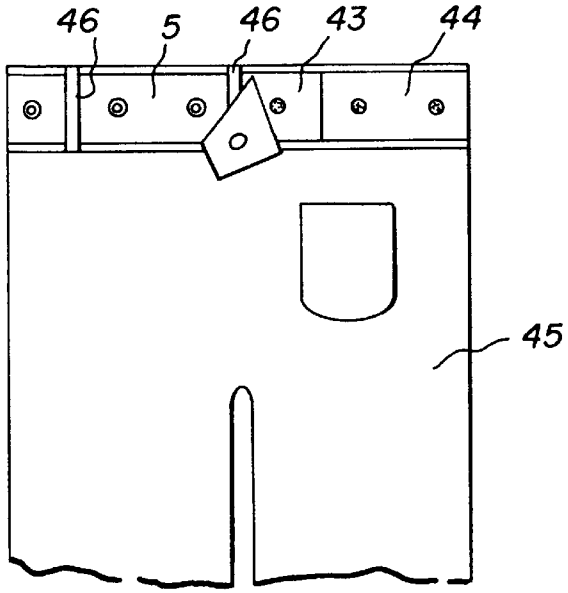
FIG. 8 is a front view of the belt of the invention in which decorative strips have been attached over the belt loops of pants.

FIG. 8 shows the belt 1 of the invention attached to pants 45. In a preferred embodiment, the decorative strips 43, 44 are secured over the belt loops 46 such that the belt loops are not visible. A particularly attractive appearance is given to the pants 45 or any garment with belt loops, where a sufficient number of decorative strips are used such that all belt loops are covered.

As shown, socket and stud elements are used for attaching the decorative strips 43, 44 to the pants 45. However, any of the attachment means described above may be utilized.

Although the invention has been described in considerable detail with respect to preferred embodiments thereof, variations and modifications will be apparent to those skilled in the art without departing from the spirit and scope of the invention as set forth in the claims.

I claim:

1. An interchangeable apparel belt set comprising:

a body encircling member insertable through belt loops on a garment and having an inner side and an outer side, said inner side being placed against a wearer's body when said belt is worn, said body encircling member including attachment means attached at substantially equally spaced intervals along the outer side; and a set of interchangeable decorative strips of varying lengths, each of said strips having front and back sides, each of said front sides including indicia for communicating messages on said body encircling member, each of said back sides including corresponding attachment means positioned at opposite ends thereof and attachable to said attachment means on said body encircling member over belt loops on a garment, such that the belt loops are positioned between said body encircling member and said decorative strips, whereby said decorative strips substantially completely cover said belt loops.

2. The interchangeable apparel belt set according to claim 1 wherein said attachment means comprises one of stud elements and socket elements attached to said outer side of said body encircling member at varying locations along a length of said body encircling member and at least two of the other of said stud elements and said socket elements attached to said back sides of each of said decorative strips at respective ends thereof for attaching said decorative strips to said body encircling member such that a belt loop on a garment is positioned between two engaged stud and socket elements.

3. The interchangeable apparel belt set according to claim 1 wherein said attachment means comprises lock elements, each of said lock elements comprising a protrusion extending outward from said outer side of said body encircling member and a slot in said decorative strips through which said protrusion is insertable, said protrusion being rotatable between an unlocked position in which said protrusion is insertable into and removable from said slot unlocked position in which said protrusion is removable from said slot.

4. The interchangeable apparel belt set according to claim 1 wherein said attachment means comprises one of hooks and loops attached to said outer side of said body encircling member at varying locations along a length of said body encircling member and at least two of the other of said hooks and loops attached to said back side of said decorative strip at respective ends thereof for attaching said decorative strips to said body encircling member such that a belt loop on a garment is positioned between two engaged hooks and loops.

5. The interchangeable apparel belt set according to claim 1 wherein said attachment means comprises stud elements secured to the outer side of said body encircling member and said set further includes individual socket elements attachable to said stud elements for covering said stud elements.

6. The interchangeable apparel belt set according to claim 5 wherein each of said decorative strips includes at least two socket elements at respective ends thereof for attaching said decorative strips to said body encircling member such that a belt loop on a garment is positioned between two engaged elements.

* * * * *